United States Patent [19]

Kurumatani et al.

[11] Patent Number: 4,869,928

[45] Date of Patent: Sep. 26, 1989

[54] INNER SURFACE COATING METHOD AND DEVICE FOR PIPING

[75] Inventors: Harumichi Kurumatani, Sakai; Takashi Nakao, Katano; Kazunori Nakano, Hirakata; Akira Kojima, Nara, all of Japan

[73] Assignee: Osaka Gas Co., Ltd., Osaka, Japan

[21] Appl. No.: 44,681

[22] Filed: May 1, 1987

[30] Foreign Application Priority Data

| | | | |
|---|---|---|---|
| Jun. 25, 1986 | [JP] | Japan | 61-148899 |
| Aug. 29, 1986 | [JP] | Japan | 61-133243 |
| Jan. 13, 1987 | [JP] | Japan | 62-007199 |

[51] Int. Cl.[4] ..... B05D 7/22

[52] U.S. Cl. ..... 427/206; 427/236; 427/239; 427/261; 427/287; 427/407.1; 427/409; 427/426

[58] Field of Search ..... 427/239, 328, 409, 421, 427/261, 287, 202, 204–206, 236, 426

[56] References Cited

U.S. PATENT DOCUMENTS

| | | | |
|---|---|---|---|
| 2,627,649 | 2/1953 | Matthysse | 427/205 |
| 4,166,536 | 9/1979 | Roberts et al. | 427/239 |
| 4,169,906 | 10/1979 | Hallstrom et al. | 427/205 |
| 4,312,902 | 1/1982 | Murase et al. | 427/239 |
| 4,543,366 | 9/1985 | Smith | 427/206 |

*Primary Examiner*—Janyce Bell

*Attorney, Agent, or Firm*—Cushman, Darby & Cushman

[57] ABSTRACT

An inner surface coating method for a piping having a step of causing an adhesive agent or a lining material to adhere to a curved portion of a pipe and sticking a reinforcing material transported by gas flowing inside the pipe at a constant flow speed of 1 to 120 m/sec to the adhesive agent or the lining material, and an inner surface coating device having a reinforcing material supplier using a reinforcing material, dispersion unit constituted by a closed primary dispersion tank for mixing the reinforcing material from a supply tank with gas supplied under pressure from a blower and by a closed secondary dispersion tank incorporating a dispersing rotary blade rotated by reinforcing material mixed gas supplied under pressure from the primary dispersion tank.

6 Claims, 3 Drawing Sheets

(a)

(b)

(c)

(a)

(b)

(c)

INNER SURFACE COATING METHOD AND DEVICE FOR PIPING

BACKGROUND OF THE INVENTION

1. Field of the Invention

The present invention concerns a method and a device for coating an inner surface of a pipe. The method includes a step of forming a layer at a curved portion of the pipe, the layer being constituted by an adhesive agent or a lining material and by a reinforcing material transported by means of gas flowing inside the pipe.

2. Description of the Prior Art

According to a conventional method for coating an inner surface of a pipe, an adhesive agent or a lining material is stuck to the whole pipe to be treated and then a reinforcing material is also caused to adhere to the whole adhesive agent or the whole lining material.

However, because of reasons as specifically set forth hereinafter, there often are occasions when the adhesion of the reinforcing material is especially needed at a curved portion of a pipe.

(a) In a piping to be treated, straight portions are hardly or not at all damaged by fluid transportation whereas curved portions are more subjected to damages because the same are violently crashed against the transported fluid.

(b) Since the inner surface of pipe is generally lined by means of gas-flow transportation of lining material, although lining may be formed with a sufficient thickness at the straight pipe portions, formed lining tends to be undesirably thin at the curved pipe portions because the lining material is often forced by the gas flow to pass therethrough.

If the conventional method is applied in the above cases, unnecessary adhesion of the reinforcing fiber often leads to pressure loss in the piping, and further especially in the case of a long piping necessary amount of reinforcing fiber increases whereby the whole treatment takes considerable time and labor.

Also, in the conventional method, the sticking operation of the reinforcing material to the adhesive agent or to the lining material has been carried out in such a way that a lining material having a viscosity of about 5000 cps is fed into the piping at a supply rate approximately 100 to 200 cc/m and at the same time pressured gas is fed into the piping at about 40 m/sec to cause a gas-liquid mixture flow to flow along the piping thereby the lining material coating the inner surface of the piping.

This method, however, provides maximum treatment speed up only to 0.5 to 3 m/min; thus, the treatment of a long piping takes considerably long time. Further, with this method, since it is difficult to treat main pipes and branch pipes at the same time, the lining operation need be carried out for each main pipe and branch pipe separately, whereby operation efficiency is extremely low.

A conventional device employed for the above operation comprises a reinforcing material supplying apparatus including a supply tank for depositing the reinforcing material, reinforcing material dispersion means for dispersing the reinforcing material supplied from the tank into gas, a mixing section for mixing gas from a blower with the reinforcing material mixed gas from the reinforcing material dispersion means and a supply passage for feeding the mixed gas from the mixing section into a piping to be treated, the reinforcing material dispersion means being constituted by an auxiliary dispersion tank and a dispersion tank serially with respect to each other for dispersing the reinforcing material into the gas in a suction passage of an ejector provided as the mixing section (Japanese Utility Model Application No. 60-97221).

However, in both the auxiliary dispersion tank and the dispersion tank, since the reinforcing material is dispersed by means of stirring effect of the suction gas of the ejector, the gas flow speed is not sufficiently high. Thus, there has been room for improvement in the dispersion efficiency.

SUMMARY OF THE INVENTION

Accordingly, the primary object of the present invention to provide an efficient method and a device for coating an inner surface of piping in which sufficient amount of reinforcing material may be reliably stuck to curved portions of a piping even if the piping has a number of branch pipes.

In order to achieve the above object, the inner surface coating method for a piping according to the present invention is characterized in that a gas flow speed at the piping is maintained at 1 to 120 m/sec and further in that a mixture ratio relative to the gas of the reinforcing material to be transported by the gas is maintained at 0.01 to 2 wt %.

Functions and effects of this method will be described hereinafter.

If the gas flow speed exceeds 120 m/sec, the adhesive agent or the lining material adhered to curved portions of piping is apt to be forced downstream and the adhesion amount of the reinforcing material at the curved portions becomes insufficient. On the other hand, if the gas flow speed is lower than 1 m/sec, fixation of the reinforcing material to the adhesive agent or to the lining material adhered to the same portions becomes insufficient, whereby effective reinforcement is not obtained. That is to say, the gas flow speed of 1 to 120 m/sec is optimal for sufficient and reliable reinforcement of the curved portions by the reinforcing fiber.

Also, if the mixture ration of the reinforcing material to be transported by the gas relative thereto exceeds 2 wt/%, more than necessary amount of the reinforcing material sticks to straight pipe portions. On the other hand, if the mixture ratio is below 0.01 wt/%, the reinforcing material need continue to be supplied over a considerably long time period in order for sufficient amount of the reinforcing material to adhere to the curved pipe portions, whereby the operation efficiency is lowered. That is to say, the mixture ratio of the reinforcing material is optimal at 0.01 to 2 wt/% for reliably and efficiently sticking sufficient amount of reinforcing material to the curved pipe portions.

Therefore, this method is highly effective for applying a sufficient amount of the reinforcing material solely to the curved pipe portions. Furthermore, the treatment operation efficiency has been greatly improved in terms of time and cost economy.

The primary object of the coating device related to the present invention for coating the inner surface of a piping is to provide a device having reinforcing material dispersion means providing a high dispersion efficiency and conveniently improved in terms of installation cost and operational cost.

It is to be noted here that in this specification the lining material generically denotes any materials (including those so-called coating materials) for coating the inner surface of a pipe except the reinforcing material and the adhesive agent.

This coating device is characterized by a reinforcing material supplying section using reinforcing material dispersion means constituted by closed primary dispersion tank for mixing a reinforcing material supplied from a supply tank with gas supplied under pressure from a blower and a closed secondary dispersion tank incorporating a rotary blade adapted for dispersion and rotated by the gas mixed with the reinforcing material supplied under pressure from the primary dispersion tank.

Functions and effects of this device will be described hereinafter.

Since the reinforcing material is stirred and dispersed in the primary dispersion tank by the pressured gas from the blower, a great amount of gas can be supplied when necessary, whereby the primary dispersion performance of the reinforcing material is enhanced compared with the conventional suction method. Further, even if there still remains some undispersed reinforcing material after the first dispersion in the primary dispersion tank, the remaining material may be highly reliably stirred and dispersed in the secondary dispersion tank, whereby the whole reinforcing material may be reliably dispersed evenly in the reinforcing material mixed gas to be supplied to the mixing section.

Moreover, if the rotary blade is to be driven by an electric motor and the like, because of a driving system needed for this results in increase in cost, size and weight of the whole device. On the other hand, according to the present invention, since the rotary blade is rotated by efficiently utilizing energy in the gas supplied under pressure into the primary dispersion tank for the purpose of enhancing the dispersion efficiency, the installation and operational costs of the device may be advantageously reduced and at the same time the device may be formed compact.

Consequently, the reinforcing material may be continuously supplied in a significantly constant manner from the mixing section to a piping to the treated, the reinforcing material being evenly applied to the lining on the inner surface of the piping, whereby the reinforcement of the interior of the piping may be carried out very reliably.

Further and other features and advantages of the coating method and device for coating the inner surface of piping related to the present invention will be understood more fully with reference to the description of the preferred embodiments to be described later.

DETAILED DESCRIPTION OF THE PREFERRED EMBODIMENTS

Firstly, a method for coating an inner surface of a piping related to the present invention will be particularly described hereinafter with reference to the accompanying drawings.

Figure 1:
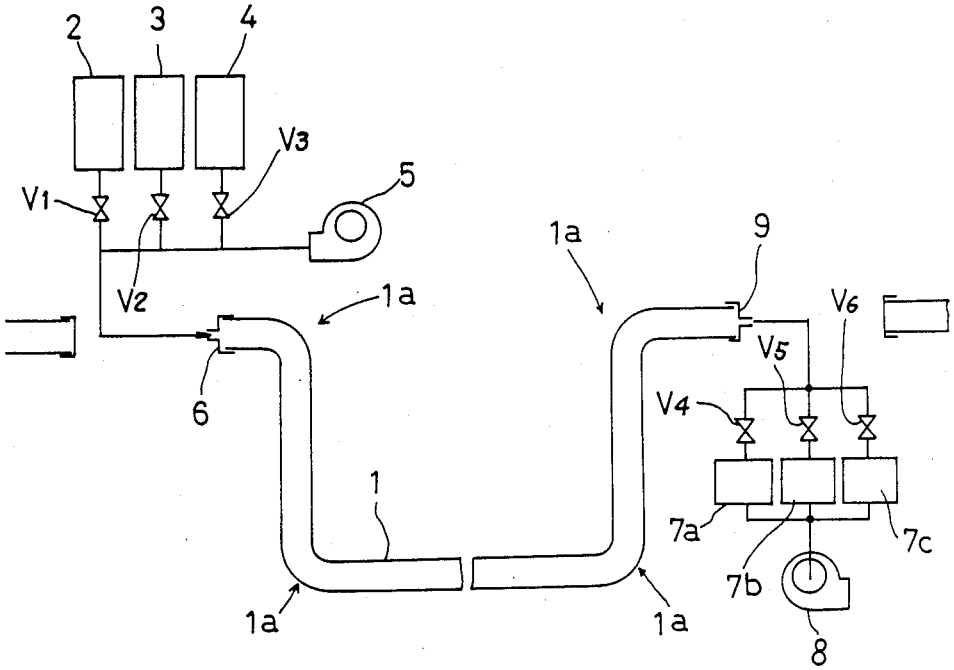
FIG. 1 is a conceptual diagram illustrating manners for embodying an inner surface coating method for a piping related to the present invention, FIG. 2(*a*), 2(*b*) and 2(*c*) are descriptive views showing various conditions in which the inner surface is coated.

Referring to FIG. 1, a pipe 1 is cut to be opened at portions thereof convenient for a reinforcing operation by using any cutting or connecting portion separator means. Then, a lid member 6 operatively connected to an adhesive agent supplier 2, a reinforcing material supplier 3, a liquid lining supplier 4 and to a blower 5 is connected to one opened end of the pipe 1 and another lid member 9 operatively connected to collectors 7*a*, 7*b*, 7*c* and to an exhauster 8 is connected to the other opened end of the pipe 1.

Through workings of the blower 5 and the exhauster 8, gas is fed into the pipe 1 at 1 to 120 m/sec, preferably at 1 to 60 m/sec. And, valves V1 and V4 alone are opened for transporting in the form of fine particles adhesive agent supplied from the adhesive agent supplier 2. Thereafter, as shown in FIG. 2(*a*), the adhesive agent 10 is caused to adhere mainly to a curved portion 1*a* and the rest of the adhesive agent is collected by the collector 7*a*, exhausting only the gas.

Figure 2:
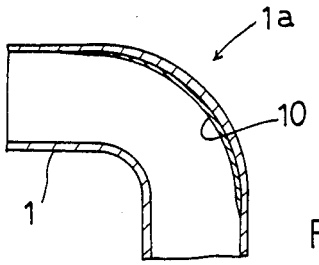
Figure 2:
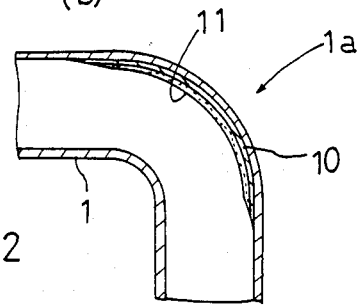
Figure 2:
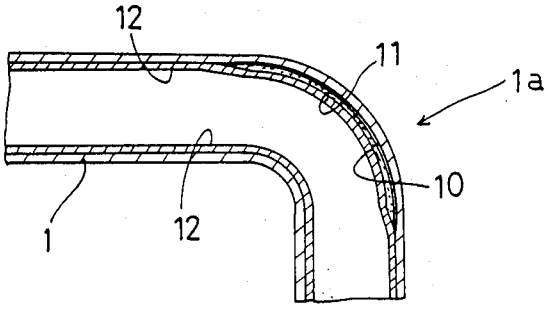

Nextly, valves V2 and V3 alone are opened to permit the reinforcing material supplier 3 to supply reinforcing material in the form of fine particles, maintaining a mixture ratio of the reinforcing material relative to the gas at 0.01 to 2 wt/%, preferably at 0.08 to 0.2 wt/% , the reinforcing material being transported inside the pipe 1 by means of the gas at 1 to 120 m/sec, preferably at 1 to 60 m/sec, and, as shown in FIG. 2(*b*), a sufficient amount of the reinforcing material 11 is caused to adhere solely to the curved portion 1*a* and the rest of the reinforcing material is collected by the collector 7*b*, exhausting only the gas.

At a next stage, valves V5 and V6 alone are opened to permit liquid type lining material supplied from the liquid lining material supplier 4 to flow along the pipe 1 or rendering the lining material into minute particles to be transported by gas. Then, as shown in FIG. 2(*c*), lining 12 covering the whole inner surface of the pipe 1 is formed with the curved portion 1*a* being reinforced by the reinforcing material 11 and the rest of the lining material is collected by the collector 7*c*, exhausting only the gas.

At the last stage of the operation, the blower 5 and the exhauster 8 are stopped and the lid members 6 and 9 are detached from the pipe 1, and, if necessary, the liquid type lining material applied to the pipe 1 is solidified in a convenient manner, e.g. supplying heated air thereto and the reinforced pipe 1 is again connected to its original place.

In the above-described embodiment, it is to be noted, the liquid type lining material is supplied to coat the overall inner surface of the pipe 1 by only one time after coating the curved pipe portion 1*a* with the reinforcing material. However, the coating operation with the lining material and the reinforcing material may be repeated by several times if necessary.

Also, if the lining material is adapted to be lower than 500 cps in its viscosity and a supply amount of the same expressed by the following equation is fed into the pipe and further if the average flow speed of the pressured gas to be supplied into the pipe is set to be 20 to 100 m/sec for transporting the lining material inside the pipe, it becomes possible to coat the lining material in a short time and also reliably even when the pipe 1 is long and is connected to a number of branch pipes.

$$Q = X^A \times y(cc)$$

where, Q is a supply amount (cc) of the lining material needed for lining the pipe, $X^A$ is the nominal diameter (cc/m) of the pipe and y is the length (m) of the pipe.

That is to say, a proper amount of lining material may be derived from the above equation constituted by the nominal diameter and the length of the pipe to be treated. Specific examples are shown in the following Table 1.

TABLE 1

| nominal diameter* (mm) | supply amount per unit length(cc/m) |
|---|---|
| $80^A$ | 80 |
| $50^A$ | 50 |
| $40^A$ | 40 |
| $32^A$ | 32 |
| $25^A$ | 25 |

*JIS G3452

The liquid type lining material comprises epoxy resin, acrylic resin or any other appropriate substance and its viscosity should be pre-adapted to be lower than 500 cps, preferably below 100 cps or more preferably below 30 cps.

Nextly, based on the nominal diameter of the pipe 1, the average flow speed inside the pipe 1 is adjusted by using the flow amount adjusting valve V3 and the like to be 20 to 100 m/sec. In this operation, it is recommended that the lining material supplier 4 be operatively connected to a compressor and the like to supply pressured gas such as air, city gas and natural gas. Then, if the liquid type lining material is transported by the supply of the pressured gas at a speed faster than 5 m/min, the whole inner surface of the pipe 1 may be coated in a short time period. The remaining lining material may be collected by the collector 7*c*.

Experiments have been carried out to observe changes in coating treatment speed with varying the nominal diameter of the pipe, the viscosity of the lining material and the gas flow speed. The results are shown in the following Table 2.

TABLE 2

| diameter mm | gas flow speed $m^5$/min | lining speed m/min viscosity 500 cps | viscosity 100 cps | viscosity 30 cps |
|---|---|---|---|---|
| 50 | 2.6~10 | about 5 | 10~20 | 100~200 |
| 40 | 1.6~10 | " | " | " |
| 32 | 1.2~5 | " | " | " |
| 25 | 0.7~5 | " | " | " |
| 20 | 0.4~5 | " | " | " |
| 15 | 0.2~5 | " | " | " |

Preferred embodiments of an inner surface coating device for piping also related to the present invention will be particularly described hereinafter with reference to the accompanying drawings.

Figure 3:
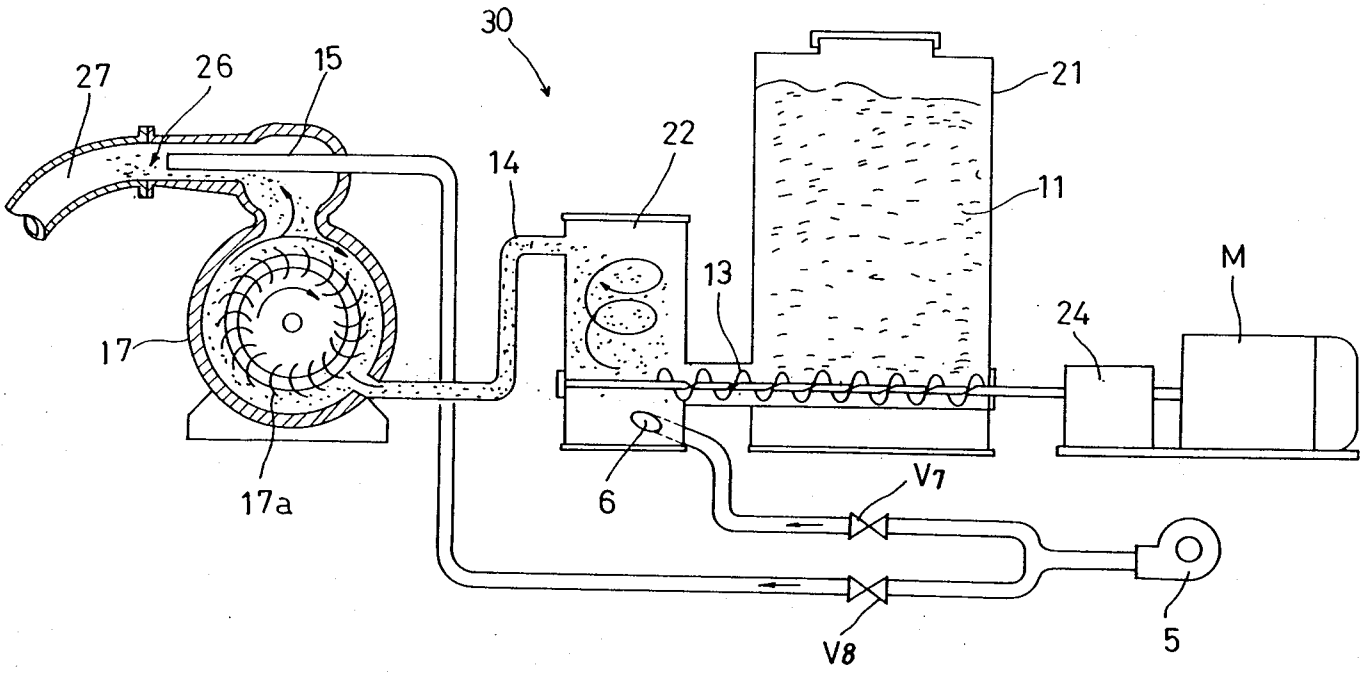
FIG. 3 is a conceptual diagram showing a reinforcing material supplying device constituting an inner surface coating device for a piping related to the present invention, FIG. 4(*a*) is a conceptual diagram showing the whole inner surface coating device connecting thereto the reinforcing material supplying device shown in FIG. 3, and FIG. 4(*b*) and FIG. 4(*c*) are descriptive views showing conditions in which the inner surface is coated by using the inner surface coating device shown in FIG. 4(*a*).

This coating device, as shown in FIG. 3, comprises a reinforcing material supplier 30 using reinforcing material dispersion means. More particularly, a closed primary dispersion tank 22 is connected through a screw conveyor 13 to a supply tank for depositing the reinforcing material 11 and there is provided a stepless change speed apparatus 24 between the screw conveyor 13 and a motor 'M', whereby the supply amount of the reinforcing material from the supply tank 21 to the primary dispersion tank is conveniently controllable.

At a lower portion inside the primary dispersion tank, there is provided a nozzle 16 operatively connected to a compressor and the like, an outlet opening of the nozzle 16 being laterally oriented for permitting gas sprayed therethrough to rise in a spiral motion along an inner peripheral face of the vertically disposed cylindrical primary dispersion tank 22, whereby the reinforcing material 11 supplied from the supply tank 21 is stirred and dispersed through this nozzle 16 with an aid of gas which amount is conveniently adjusted by a flow amount adjusting valve V7.

Inside a closed secondary dispersion tank 17, there is provided a dispersing rotary blade 17*a* to be freely rotatable about a horizontally disposed axis. A supply passage 14 for reinforcing material mixed gas from the primary dispersion tank 22 is connected to the secondary dispersion tank 17, an outlet opening of the supply passage 14 being disposed in such a way as to permit the reinforcing material mixed gas supplied under pressure therethrough to rotate the dispersing rotary blade 17*a*, whereby the dispersion of the reinforcing material may be promoted through a mechanical stirring action of the rotary blade 17*a*.

To the secondary dispersion tank 17, there is connected a mixing section 26 for mixing the mixture gas containing the reinforcing material having been sufficiently dispersed by the reinforcing material dispersion means constituted by the primary dispersion tank 22 and by the secondary dispersion tank 17 with gas sprayed through another nozzle 15 connected to the blower 5. Further, there is provided another supply passage 27 for feeding the reinforcing material mixed gas from the mixing section 26 into a pipe to be treated. Between the blower 5 and the nozzle 15, there is provided another flow amount adjusting valve V8 for controlling the supply amount of the gas to the nozzle 15.

Nextly, there will be described, by way of example, a construction and an operation of the inner surface coating device having the above-described reinforcing material supplier 30.

Figure 4:
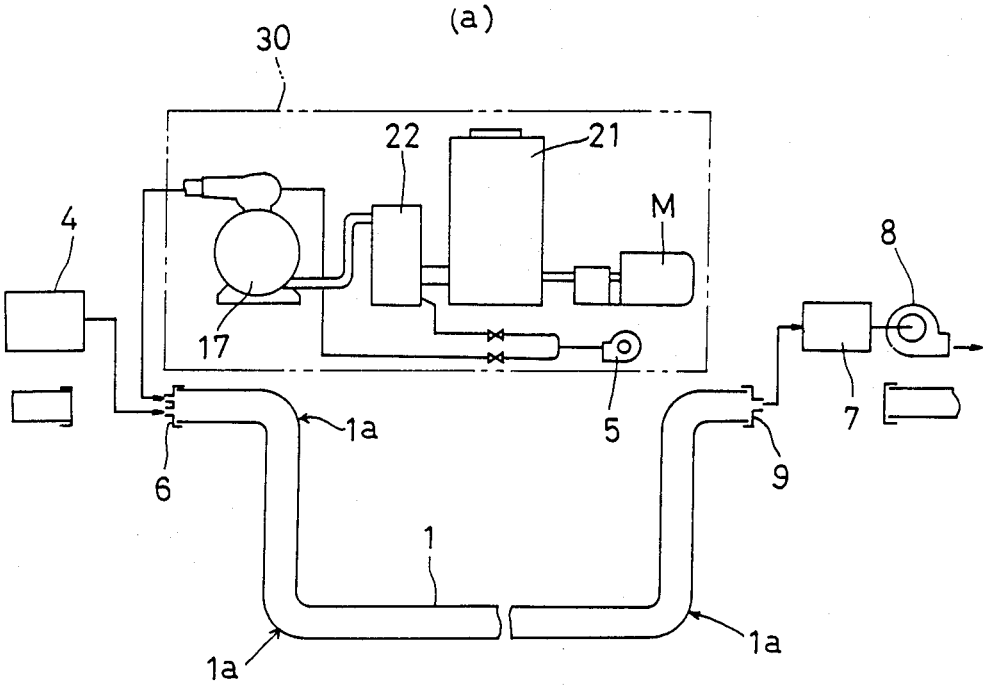
Figure 4:
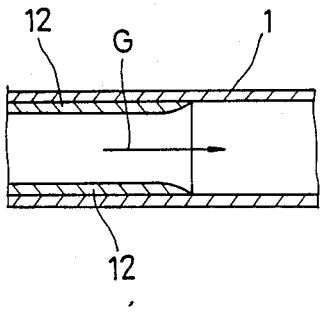
Figure 4:
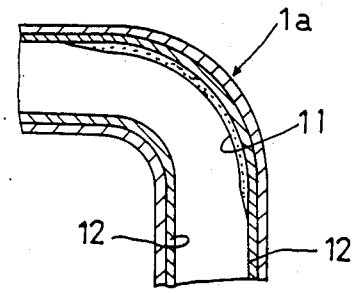

Referring to FIG. 4(*a*), the pipe 1 having the curved portion 1*a* is cut to be opened at portions thereof convenient for a reinforcing operation. Then, in the same manner as described hereinbefore with reference to FIG. 1, the lid members 6 and 9 are connected to the opened ends of the pipe 1. The lid member 6 is operatively connected to the reinforcing material supplier 30 and also to the lining material supplier 4; whereas, the lid member 9 attached to the other opened end is operatively connected to the collector means 7 for collecting the liquid type lining material and the reinforcing material and also to the exhauster 8.

Then, the lining material supplier 4, the blower 5 and the exhauster 8 are started and at the same time the screw conveyor 3 is stopped, whereby, as illustrated in FIG. 4(*b*), the gas-liquid mixture flow containing the liquid type lining material and the gas is caused to move inside the pipe 1 at a speed fast enough to flow along the pipe 1. More specifically, the gas 'G'containing the liquid type lining material in the form of fine particles is caused to flow at a high speed at a central portion of the pipe 1 and at the same time the liquid type lining material, which is still maintained in the form of liquid, is transported along the inner surface of the pipe and further remaining lining material in the form of fine particles is collected by the collector means 7 whereby only the gas is exhausted.

After the liquid lining material 12 is applied by appropriate thickness on the whole inner surface of the pipe 1, the lining material supplier 4 is stopped and then the screw conveyor 3 is operated to provide proper flow amount, thereby causing the gas evenly mixed with the reinforcing material to flow at a high speed inside the pipe 1, such that, as shown in FIG. 4(*c*), the reinforcing material 11 accumulatedly adheres to the liquid type lining material 12 solely at a curvature radial portion of the curved portion 1*a* , and the unused reinforcing material 11 is collected by the collector means 7, exhausting only the gas.

Thereafter, the lining material is stuck to the overall inner surface of the pipe and then solidified in any appropriate fashion. Then, the blower 5, the exhauster 8 and the screw conveyor 8 are stopped, the lid members 6, 9 are detached from the pipe 1 and the pipe 1 is again connected to its original place.

The pipe 1 to be treated by the method and the device related to the present invention mainly comprises a pre-installed piping such as for city gas, natural gas, water and the like; however, the method and the device is also applicable for various kinds of piping and others to be newly installed.

The respective constructions of the supply tank 21, the primary dispersion tank 22, the screw conveyor 3 disposed therebetween, the secondary dispersion tank 17 and of the mixing section 26 may be conveniently modified in accordance with the kind and the characteristics of the reinforcing material to be employed.

As for the dispersing rotary blade 17*a* also, its specific construction, its number to be installed, its direction of rotation and the like may be changed if necessary.

The primary dispersion tank 22 and the mixing section 26 may be respectively connected to two independently provided blowers 5. The specific construction of the blower 5 may be also conveniently changed. The gas to be supplied by the blower 5 may be freely selected from a group consisting of air, inert gas and the like.

The adhesive agent and the lining material may comprise any of various known materials such as of thermosetting type, cold setting type and of other types. When both the adhesive agent and the lining material are employed, these may be the same or different from each other in their characteristics.

Further, as for the reinforcing material, its characteristics, size, shape, mixture ratio and so on may be freely selected, but in general one of various kinds of such organic or inorganic fiber as glass fiber, carbon fiber, polyvinyl alcohol synthetic fiber, natural fiber and the like is used with its length less than 30 mm, preferably less than 20 mm, its thickness less than 1000 μm, preferably less than 10 μm.

The mixing section 26 connected to the supply passage 27 may be conveniently modified in accordance with utilizing conditions of the reinforcing material; for example, the section may be formed as a mixer for the liquid type lining material and the reinforcing material.

What is claimed is:

1. An inner surface coating method for a piping comprising the steps of:

causing a particulate adhesive agent or a lining material transported by a first passage gas at a flow rate of 1–120 m/sec to adhere to the inner surface at at least a curved portion of said piping so that said adhesive agent or lining material remain in a tacky conditions:

sticking a fiber reinforcing material transported by a second passage of gas flowing inside said pipe to said adhesive agent or said lining material at said curved portion; and maintaining a flow speed of said second passage gas at 1 to 120 m/sec and at the same time maintaining a mixture ratio of said reinforcing material relative to said second passage gas at 0.01 to 2 wt %.

2. An inner surface coating method for a piping, as defined in claim 1, wherein said flow speed of said second passage gas is maintained at 1 to 60 m/sec and at the same time said mixture ratio of said reinforcing material relative to said gas is maintained at 0.08 to 0.12 wt %.

3. An inner coating method for a piping, as defined in claim 2, wherein said step of causing said lining material to adhere to said inner surface includes the steps of feeding a liquid type lining material and controlling a supply thereof to adjust viscosity thereof to be lower than 500 cps according to the following equation:

$$Q = X^A(\text{mm}) \cdot y(\text{cc})$$

wherein Q is a supply amount (cc) of the lining material needed for lining the pipe, $X^A$ is the nominal diameter cc/m of the pipe and y is the length of said pipe, and after sticking said reinforcing material to said adhesive agent or to said lining material at said curved portion of said pipe, adjusting a pressured third passage of gas to be supplied into said pipe at a rate of 20 to 100 m/sec in average flow speed thereby causing additionally supplied lining material to move inside said pipe.

4. An inner coating method for piping, as defined in claim 3, wherein said reinforcing material is selected from the group consisting of organic or inorganic fibers of glass fiber, carbon fiber, polyvinylalcohol synthetic fiber and natural fiber.

5. An inner surface coating method for a piping, as defined in claim 3, wherein said lining material is selected from the group consisting of thermosetting type and cold setting type and wherein when both of said adhesive agent and said lining material are employed the same may be the same or different from each other in characteristics thereof.

6. An inner surface coating method for piping, as defined in claim 4, wherein said fiber has a length of less than 30 mm and a thickness of less than 1000 μm.

* * * * *